US005263602A

United States Patent [19]

Lathouris

[11] Patent Number: 5,263,602

[45] Date of Patent: Nov. 23, 1993

[54] CONTAINER SYSTEM FOR RECYCLING BEVERAGE CANS AND THE LIKE

[76] Inventor: Emmanuel D. Lathouris, P.O. Box 212, Huntington, N.Y. 11743

[21] Appl. No.: 954,728

[22] Filed: Sep. 30, 1992

[51] Int. Cl.[5] ..... A47G 19/00; B65D 75/00

[52] U.S. Cl. ..... 220/23.83; 220/501; 220/513; 220/515; 220/516; 206/430; 206/499; 248/99; 248/128; 248/907

[58] Field of Search ..... 220/909, 908, 404, 401, 220/23.83, 23.4, 501, 500, 516, 513, 512, 509, 515; 248/907, 146, 99, 129, 128; 206/430, 427, 499

[56] References Cited

U.S. PATENT DOCUMENTS

| | | | |
|---|---|---|---|
| 3,332,651 | 7/1967 | Fleischhauer | 248/146 |
| 4,175,602 | 11/1979 | Cavalaris et al. | 220/401 X |
| 4,396,120 | 8/1983 | Morita | 206/499 X |
| 4,542,826 | 9/1985 | Adams | 206/430 X |
| 4,542,930 | 9/1985 | Adams | 206/427 X |
| 4,721,317 | 1/1988 | Avot | 248/129 X |
| 4,735,313 | 4/1988 | Schoenberg | 206/427 |
| 4,765,579 | 8/1988 | Robbins, III et al. | 220/908 X |
| 4,877,068 | 10/1989 | Blake | 206/427 X |
| 4,979,705 | 12/1990 | Bovitz | 248/99 X |
| 4,984,704 | 1/1991 | O'Malley | 220/909 X |
| 5,090,587 | 2/1992 | Brown | 220/909 X |

*Primary Examiner*—Allan N. Shoap
*Assistant Examiner*—Paul A. Schwarz
*Attorney, Agent, or Firm*—Richard L. Miller

[57] ABSTRACT

A container system for recycling beverage cans and the like is provided, which consists of a plurality of containers, each having an upper flange and a contoured vertical inner surface, so as to permit the stacking of discarded beverage cans and the like one upon the other in side by side relationships and a stand for supporting each container by the upper flange one directly next to the other so as to take up minimum room in an orderly fashion. An inner disposable liner can than be removed with the discarded beverage cans contained therein while simultaneously preventing any remnants contained in any can from soiling the surrounding and appropriately sent to a proper recycling collection point.

4 Claims, 1 Drawing Sheet

CONTAINER SYSTEM FOR RECYCLING BEVERAGE CANS AND THE LIKE

BACKGROUND OF THE INVENTION

The instant invention relates generally to recyclable trash receptacles and more specifically it relates to a container system for recycling beverage cans and the like.

Numerous trash receptacles have been provided to the prior art that are adapted to separate trash into different categories, so that the trash can be gathered to be recycled. For example, Kostle, U.S. Pat. Nos. 3,804,218; Ertley No. 4,682,699 and Haynes No. 4,821,903 all are illustrative of such prior art. While these units may be suitable for the particular purpose to which they address, they would not be as suitable for the purpose of the present invention as hereafter described.

SUMMARY OF THE INVENTION

A primary object of the present invention is to provide a a container system for recycling beverage cans and the like that will overcome the shortcomings of the prior art devices.

Another object is to provide a container system for recycling beverage cans and the like that will stack and store the beverage cans and the like in an inner liner in a container supported on a stand, so that the inner liner can be removed for quickly an easily recycling the contents therein.

An additional object is to provide a container system for recycling beverage cans and the like in which the containers will take up less room than ordinary standard trash bins, since the beverage can and the like are neatly stacked therein one upon the other in side by side relationships.

A further object is to provide a container system for recycling beverage cans and the like that is simple and easy to use.

A still further object is to provide a container system for recycling beverage cans and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
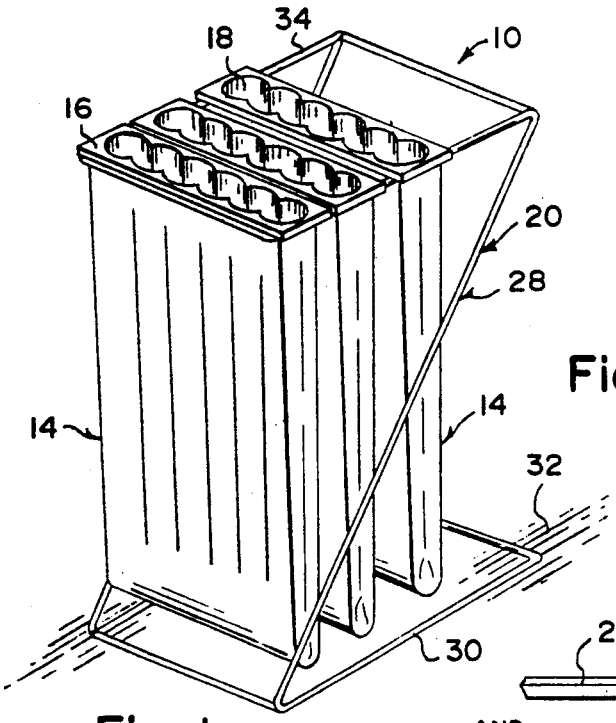
FIG. 1 is a diagrammatic perspective view of the instant invention assembled and ready for use.
Figure 2:
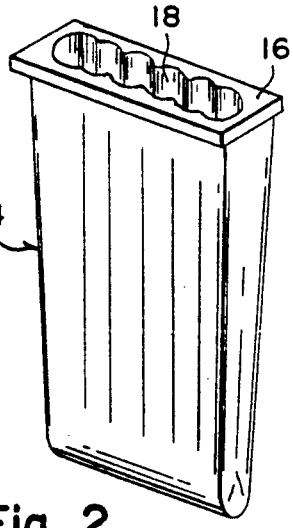
FIG. 2 is a perspective view of just one of the containers per se thereof.
Figure 3:
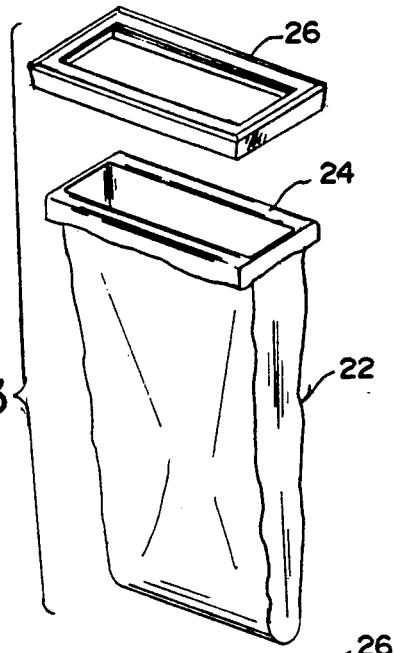
FIG. 3 is a perspective view of one of the inner liners thereof.
Figure 4:
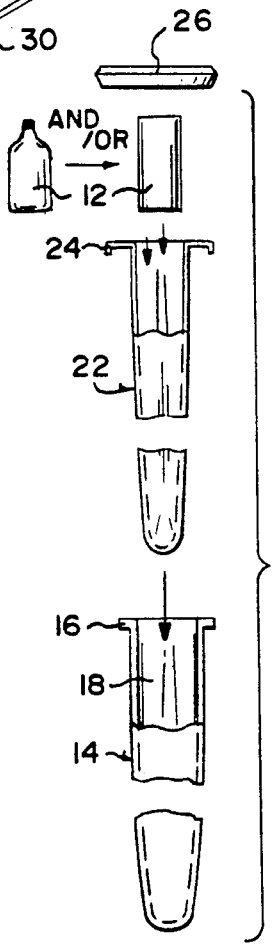
FIG. 4 is a diagrammatic exploded view illustrating the cooperation between components.
Figure 5:
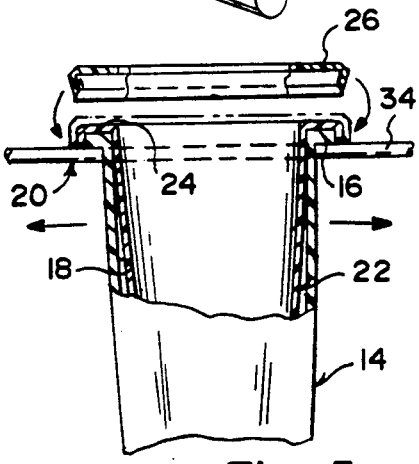
FIG. 5 is an enlarged cross sectional view with parts broken away illustrating further construction details.
Figure 6:
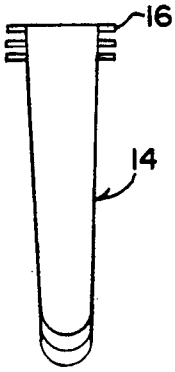
FIG. 6 is a diagrammatic view illustrating how the container components can be stacked.

Turning now descriptively to the drawings, in which similar reference characters denote similar elements throughout the several views, the Figures illustrate a container system 10 for recycling beverage cans and the like 12 which consists of a plurality of containers 14, each having an upper flange 16 and a vertically extending inner wall having a contoured surface forming a horizontally extending row of vertically extending intercommunicable compartments 18, so as to stack the beverage cans and the like 12 one upon the other in side by side relationships. A stand 20 is for supporting each container 14 by the upper flange 16 one directly next to the other, so as to take up less room.

The container system further includes a plurality of inner liners 22, each having a fold over upper edge 24. Each inner liner 22 can fit into the compartments of each container with the fold over upper edge 24 extending over the upper flange 16 of each container 14. Each inner liner 22 can be removed when full with the beverage cans and the like 12 processed for recycling.

The container system further includes a plurality of frame covers 26, each sized to snap over the fold over upper edge 24 of each inner liner 22 and the upper flange 16 of each container 14, so as to keep the fold over upper edge 24 of each inner liner 22 in place.

The stand 20 is formed typically of a Z-shaped tubular construction 28 in which a bottom portion 30 thereof sits upon a flat surface 32, while a top portion 34 thereof engages with a bottom surface of each upper flange 16 on each container 14.

In operative use the instant invention 10 is set upon the floor surface 32 with a plurality containers 14, having vertical inner surfaces 18, assembled with an appropriate liner 22 and a respective frame cover 26, snap on each, to keep the fold over upper edge 24 of each inner liner 22 in place. As required by the user the assembly is then filled with discarded beverage cans and similar articles. When so filled a frame cover 26 is separated there from and the appropriate inner liner 22 is pulled from the assembly with the contents 12 therein for delivery to a recycle can crushing machine or other collection facility. Accordingly another clean liner 22 is installed in the stand 20 so that the user can in an orderly manner continue to store discarded can 12 while preventing any remnants contained therein from contaminating the container 14.

While certain hovel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A container system for recycling beverage cans which comprises:

a) a plurality of elongated containers each having an upper flange and a vertically inner extending wall having a contoured surface forming a horizontally extending row of vertically extending intercommunicable compartments each of the compartments being open at a top and of a size for obtaining through the top successive single beverage cans one by one, so as to stack the beverage cans one upon the other in closely adjacent columns in a side by side relationship; and b) a stand for supporting each said container by the upper flange with the containers in closely adjacent side by side relation in an orderly manner.

2. A container system as recited in claim 1, further including a plurality of flexible inner bag-form liners, each having a fold over upper edge, each said inner liner fitting into the compartment of each container with the fold over upper edge extending over the upper flange of each said container, so that each said inner liner can be removed when full and with the beverage cans for recycling.

3. A container system as recited in claim 2, further including a plurality of frame covers, each sized to snap over the fold over upper edge of each said inner liner and the upper flange of each said container, so as to keep the fold over upper edge of each said inner liner in place.

4. A container system as recited in claim 3, wherein said stand is of a Z-shaped tubular construction having a bottom portion provisioned to sit upon a flat surface, while a top portion thereof engages with a bottom surface of each upper flange on each said container to be supported therein.

* * * * *